US005292446A

United States Patent [19]

Painter et al.

[11] Patent Number: 5,292,446

[45] Date of Patent: Mar. 8, 1994

[54] NONPHOSPHATED AUTOMATIC DISHWASHING COMPOSITIONS WITH OXYGEN BLEACH SYSTEMS AND PROCESS FOR THEIR PREPARATION

[75] Inventors: Jeffrey D. Painter, Cincinnati; Janet L. Marshall, Wyoming; James C. B. St. Laurent, Cincinnati, all of Ohio

[73] Assignee: The Procter & Gamble Company, Cincinnati, Ohio

[21] Appl. No.: 908,616

[22] Filed: Jun. 29, 1992

Related U.S. Application Data

[63] Continuation-in-part of Ser. No. 613,190, Nov. 14, 1990, abandoned.

[51] Int. Cl.[5] ..... C11D 3/37; C11D 7/12; C11D 7/18; C11D 17/06

[52] U.S. Cl. ..... 252/99; 252/89.1; 252/95; 252/102; 252/174; 252/174.14; 252/174.19; 252/174.24; 252/DIG. 11

[58] Field of Search ..... 252/95, 99, 102, 174.19, 252/174.24, 174.14, 89.1, 174, DIG. 11

[56] References Cited

U.S. PATENT DOCUMENTS

| | | | |
|---|---|---|---|
| 4,127,496 | 11/1978 | Stokes | 252/102 |
| 4,182,684 | 1/1980 | Lannert | 252/DIG. 11 |
| 4,203,858 | 5/1980 | Chakrabarti | 252/135 |
| 4,244,832 | 1/1981 | Kaneko | 252/99 |
| 4,427,417 | 1/1984 | Porasik | 252/135 |
| 4,436,642 | 3/1984 | Scott | 252/95 |
| 4,539,144 | 9/1985 | Ridder | 252/526 |
| 4,680,131 | 7/1987 | Busch | 252/102 |
| 4,704,233 | 11/1987 | Hartman | 252/DIG. 11 |
| 4,820,440 | 4/1989 | Hemm | 252/135 |
| 4,846,993 | 7/1989 | Lentsch | 252/95 |
| 4,959,409 | 9/1990 | Heinzman | 252/61 |
| 4,983,315 | 1/1991 | Glogowski | 252/DIG. 11 |

FOREIGN PATENT DOCUMENTS

| | | | |
|---|---|---|---|
| 0066924 | 12/1982 | European Pat. Off. | C11D 3/395 |
| 0192442 | 8/1986 | European Pat. Off. | C11D 3/20 |
| 0239379 | 9/1987 | European Pat. Off. | C11D 3/386 |
| 0267653 | 5/1988 | European Pat. Off. | C11D 3/33 |
| 2062465 | 6/1972 | Fed. Rep. of Germany | C11D 3/33 |
| 673033 | 1/1990 | Switzerland | C11D 3/08 |

*Primary Examiner*—Dennis Albrecht
*Attorney, Agent, or Firm*—Ken K. Patel; Ronald L. Hemingway; Jacobus C. Rasser

[57] ABSTRACT

Disclosed is a process for making nonphosphated automatic dishwashing detergents which have granular form and comprise a conventional nonphosphorus builder system consisting essentially of an organic builder salt (such as citrate) and a dispersant (such as a polyacrylate); and an oxygen bleach system comprising a chelant (such as ethylenediamine disuccinate) and a bleach active (such as perborate or percarbonate) optionally with enzymes and/or dry-mixed hydrous silicates. The invention secures stable, free-flowing granules by a premix step in which the chelant and dispersant are brought together; a drying step using conventional equipment; and one or more admix steps in which the bleach active is mixed with the product of the drying step.

2 Claims, No Drawings

NONPHOSPHATED AUTOMATIC DISHWASHING COMPOSITIONS WITH OXYGEN BLEACH SYSTEMS AND PROCESS FOR THEIR PREPARATION

This is a continuation of application Ser. No. 613,190, filed on Nov. 14, 1990 now abandoned.

TECHNICAL FIELD

The present invention is in the field of granular automatic dishwashing compositions. More specifically, the invention relates to making nonphosphated forms (i.e., substantially free from inorganic phosphate salts) of such compositions wherein there is present an oxygen bleach system (such as chelant and sodium perborate) together with an organic dispersant (such as a polyacrylate).

BACKGROUND OF THE INVENTION

The art is replete with disclosures of nonphosphated granular cleaning compositions, often containing esoteric ingredients. Numerous processes have been disclosed for their making. However, the practical formulator is often confronted with problems stemming from a need to incorporate commercially available ingredients into the composition's matrix using conveniently accessible processing equipment. Unfortunately, equipment available to the formulator is likely to have been designed to give excellent results in the days when most of the ingredients of automatic dishwashing compositions were inorganic (e.g., sulfate, carbonate, silicate, hydroxide and phosphate salts).

In modern automatic dishwashing compositions a major inorganic builder ingredient, phosphate salts, are often replaced by citrate salts. The citrate salts are conveniently available in granular form, and can simply be dry-added to the compositions. However, cleaning adjuncts such as organic dispersants, which are very useful in nonphosphated compositions, are much more difficult to handle; their most common commercial form is that of a viscous aqueous solution. Of course the consequence of adding citrate and/or organic dispersants and removing phosphate or similar inorganic salts is that it becomes much more difficult to form discrete, crisp, free-flowing particles from the combined components in conventional agglomeration processes.

Moreover, it would be desirable to provide automatic dishwashing compositions incorporating an oxygen bleach system to replace chlorine bleaches. It is known, for example, that chlorine bleaches have certain disadvantages such as a tendency to darken silverware. Unfortunately, it can be very difficult to produce effective agglomerated nonphosphated automatic dishwashing compositions with appreciable contents of oxygen bleach systems on a commercial scale. Problems include that oxygen bleaches often take up more formulation space than chlorine bleaches, worsening the above-described processing problems since the bleach-active salts, such as sodium perborate, are too reactive to be used in wet mix/drying process stages. Also, there are problems of bleach stability and bleach compatibility with other ingredients in the compositions.

Accordingly, it is an object of the present invention to provide a new and improved process for making nonphosphated granular automatic dishwashing compositions comprising an oxygen bleach system (e.g., chelant plus perborate salts) and an organic dispersant.

Another object herein is to provide such dishwashing compositions in the form of stable, free-flowing granules. These and other objects are secured, as can be seen from the following disclosure.

BACKGROUND ART

U.S. Pat. Nos. 4,284,524, Aug. 18, 1981, to Gilbert, and 4,714,562, Dec. 22, 1987, to Roselle and Weatherby, relate to automatic dishwashing compositions.

SUMMARY OF THE INVENTION

The present invention encompasses a process for making a nonphosphated granular automatic dishwashing composition which is substantially free from inorganic phosphate builders, comprising:

(a) forming a fluid premix comprising an aqueous mixture of a chelant and an organic dispersant, said chelant and organic dispersant being at a weight ratio of from about 3:1 to about 1:300, preferably from about 1:3 to about 1:50, most preferably from about 1:4 to about 1:25, dry basis, and said fluid premix comprising from about 30% to about 70% water (preferably about 50% to about 65%) and about 30% or higher (preferably about 35% to about 50%) of the sum of said chelant and said organic dispersant;

(b) in one or more mixing/drying steps, co-contacting the fluid premix of step (a) with solid-form water-soluble nonphosphorus salts at a weight ratio of said fluid premix to solid-form water-soluble nonphosphorus salts of from about 1:30 to about 1:4, preferably from about 1:10 to about 1:4, to form a particulate agglomerate and drying said agglomerate to about 8% or less free moisture; and (c) one or more steps of mixing the particulate agglomerate of step (b) with solid-form particulate admixes comprising bleach-active salts (especially those selected from perborate salts, percarbonate salts and mixtures thereof), said bleach-active salts constituting 3% or more, dry weight basis, of the total composition.

A preferred process herein is wherein said chelant in step (a) is selected from the group consisting of ethylenediamine disuccinate salts; diethylenetriamine pentaacetic acid salts; and mixtures thereof, and the organic dispersant in step (a) is selected from the group consisting of polyacrylate salts (m.w. 1,000–10,000); acrylate-co-maleate salts (m.w. 10,000–100,000); and mixtures thereof.

Processes herein generally achieve high-density, yet readily water-soluble, compositions, typical densities being about 0.8 g per cubic centimeter or higher, more preferably 0.9 g per cubic centimeter or higher. The useful processes encompass both concurrent mixing/drying and sequential mixing followed by drying in step (b). To achieve the high densities, sequential agglomeration followed by fluidized-bed drying is preferred in step (b).

A preferred process herein is wherein the chelant in step (a) is selected from the group consisting of ethylenediamine disuccinate salts; diethylenetriamine pentaacetic acid salts; 1,2-oxoethanediylbis(aspartate) salts and mixtures thereof, and the organic dispersant in step (a) is selected from organic polycarboxylate dispersants, especially those selected from the group consisting of polyacrylate salts (m.w. 1,000–10,000); acrylate-co-maleate salts (m.w. 10,000–100,000); and mixtures thereof.

The chelant can be solid-form (i.e., 100% concentration) or can be nonsolid, e.g., concentration below 100% but above 40%, preferably higher e.g., about 90%. In any event, the chelant dissolves in the aqueous organic dispersant in step (a) forming a very useful intermediate composition which can, if desired, be manufactured at a chelant/dispersant chemicals manufacturing facility remote from that at which the final composition is completed.

When the organic dispersant in step (a) is provided in aqueous form, the concentration is preferably about 35% to about 50%. The pH of the combined chelant and dispersant (i.e., the product of step [a]) is often in the range from about 6, preferably 7, to about 8.5 for best results.

A preferred process herein is wherein, in step (b), said solid-form water-soluble nonphosphorus salt is a mixture of sodium citrate dehydrate, sodium carbonate and sodium sulfate, and the drying is continued to about 6%, or less, preferably about 3% or less, free moisture.

In a convenient mode, the process herein employs a chelant which is in the form of a paste or solid which is the product of an acetone treatment of an aqueous solution of said chelant, followed by decantation of the acetone layer.

In a highly preferred process herein, the percentages by weight, dry basis, of chelant, organic dispersant, solid-form water-soluble nonphosphorus salt and sum of step (c) admixes including bleach-active salts, are as follows: chelant: from about 0.05% to about 5%, preferably from about 0.15% to about 1.0%; organic dispersant: from about 0.5% to about 12%; solid-form water-soluble nonphosphorus salts: from about 30% to about 95%, preferably from about 35% to about 80%; and sum of step (c) admixes: from about 5% to about 55%, preferably from about 15% to about 40%. Very preferably, the latter admixes comprise (along with the bleach-active salts) flowable, water-soluble, solid-form hydrous sodium silicate, especially having $SiO_2$:$Na_2O$ ratio of about 2:1 to about 2.4:1.

All percentages, ratios and proportions herein are by weight, unless otherwise specified.

DETAILED DESCRIPTION OF THE INVENTION

It is to be understood that the granular automatic dishwashing compositions provided by the present invention comprise ingredients otherwise known in the art. This is true both of the essential ingredients, namely chelants, bleach-active salts, organic dispersants and solid-form water-soluble nonphosphorus salts, and of the optional adjuncts, such as silicates, surfactants, perfumes, colorants, bleach-activators, peracids and the like. The invention herein provides a unique process for combining such ingredients, with or without the optional adjuncts, into free-flowing granular automatic dishwashing compositions using conventional detergent processing equipment.

Process

Although the art includes processes which rely on dry-mixing or spray-drying ingredients, such processes are not of the general kind of interest herein as they generally produce products with low density or high tendency to segregate in the package. Thus for the present purposes, conventional automatic dishwashing compositions can typically be made by a process comprising two essential stages: mixing/drying wet-and-dry ingredients to form particles having granulometry generally appropriate for the intended use; and mixing free-flowing, relatively dry components, of compatible granulometry, with the product of the first stage. The latter mixing stage is, of course, necessary since bleach-active salts such as sodium perborate are not tolerant of the wet-stage processing.

As compared with the known processes for making granular automatic dishwashing detergents with oxygen bleach, preferred embodiments of this invention, in outline, comprise: (a) in the presence of water, forming a fluid premix consisting essentially of an organic dispersant and a chelant (the latter constitutes an especially important component of oxygen bleach systems as defined herein; each component is more fully described hereinafter); (b) one or more mixing/drying steps wherein the fluid premix is contacted with solid-form water-soluble nonphosphorus salts (very preferably, by means of conventional agglomeration and fluidized-bed drying equipment, sequentially); and (c) addition of bleach-active salts. Optionally, additional spray-ons or additions of other components such as perfumes, and the like, can be performed. Particularly desirable options which can be accommodated are illustrated by (i) inclusion of perfume in the step (a) premix; (ii) inclusion of fluid-form surfactant in step (b) and (iii) inclusion of hydrous silicates in step (c). Other optional adjuncts can also, in general, be added in steps (a), (b) or (c).

In one preferred embodiment, the chelant is dry. Although it might have seemed more expedient to add the chelant in its dry state at the end of the process, it is nonetheless mixed with organic dispersant in step (a) of the instant process.

In many cases, chelants are commercially shipped in the form of aqueous solutions, e.g., as the sodium salt. When such solutions are relatively dilute, the practice according to another preferred embodiment of this invention is to reduce the water content of the chelant, i.e., to preconcentrate it, before the step (a) mixing with the organic dispersant. One way of doing this is by evaporation. Another preferred way of achieving separation of water from chelant before conducting process steps (a), (b) and (c) is to mix the dilute aqueous chelant with acetone. This gives a two-phase mixture comprising an oil or solid comprising the chelant (retained for use in step [a]), and an aqueous/acetone supernatant (not needed for further use in the process). The supernatant is separated from the chelant oil or solids, which are then optionally further evaporated to remove any last traces of acetone. The chelant is then mixed with the organic dispersant in step (a).

A third approach to reducing the water content of the chelant is to acidity the chelant solution; however, this has serious disadvantages. Without being limited by theory, it is believed that acid-form chelant is frequently of such low water-solubility that it does not subsequently disperse well in the subsequent process stages.

One important advantage of the instant process is its nonreliance on caustic silicates as liquid binders in step (b). It has been found that such inorganic liquid binders result in a less soluble product, which is a significant disadvantage for the user of the compositions. Moreover, and not being limited by theory, it is believed that the chelant/dispersant premix used herein confers advantages in the process and resulting compositions, such as in delivering a useful and easily handled intermediate composition; better agglomeration/drying characteristics and superior finished product especially from the viewpoint of a highly effective, stabilized oxygen bleach system. Surprisingly, when perfume is included in step (a), the finished product has excellent odor impact even when the drying temperatures in step (b) are high. Other surprising advantages include the ability to process, and make fully-formulated automatic dishwashing detergents with relatively temperature-sensitive organic dispersants and chelants, including certain chelant materials not hitherto known to have been used in automatic dishwashing detergents, without significant loss of their activity.

Oxygen Bleach System

Granular automatic dishwashing detergents in accordance with the invention comprise an oxygen bleach system. At a minimum, such a bleach system has two components, namely a bleach-active salt and a chelant. The two components work effectively, especially in the presence of dispersants and nonphosphorus salts described in more detail hereinafter, for excellent removal of difficult food and beverage stains from dishware. In addition to the essential components, the oxygen bleach system may optionally comprise bleach activators or peracids, the latter especially of the high water-solubility type.

In accordance with the process described herein, the essential components of the oxygen bleach system are introduced into the final composition at separate stages; notably, the chelant is incorporated in step (a) while bleach-active salt is added in step (c). Optionally, extra chelant above the step (a) prescribed levels may be dry-added together with the bleach-active salts in step (c); however, this is neither cost-effective nor is it known to produce any extra advantage. Indeed, there are likely to be disadvantages in this option, especially when the solid-form chelant is used as a hygroscopic sodium salt.

In more detail, the components of the oxygen bleach system are as follows:

Chelant

The chelant in the fully-formulated granular automatic dishwashing detergent compositions herein can be used at levels ranging from the minimum amount required for bleach stabilizing purposes (e.g., as low as about 0.05% to 0.1%) to much higher levels (e.g., about 0.5% or higher) which are very useful levels not only for best achieving the instant process, but also for achieving enhanced functionality of the automatic dishwashing detergent (e.g., food/beverage stain removal from dishes, transition metal oxide film removal, and the like.) Typical levels are thus from about 0.05% to about 2% or higher, preferably from about 0.15% to about 1%, most preferably from about 0.19% to about 0.8%, all percentages on a weight basis of the final automatic dishwashing composition.

Chelants suitable for use herein are further illustrated by the sodium and potassium salts of ethylenediaminetetraacetic acid (EDTA), ethylenediaminetetra(methylenephosphonic acid), diethylenetriaminepenta(methylenephosphonic acid), diethylenetriaminepentaacetic acid (DTPA), hydroxyethylenediaminetriacetic acid (HEDTA), triethylenetetraminehexaacetic acid (TTHA), hydroxyethylidinediphosphonic acid (EHDP), nitrilotriacetic acid (NTA), N,N'-(1-oxo-1,2,-ethanediyl)-bis(aspartic acid) (OEDBA), and ethylenediaminedisuccinic acid (EDDS).

Highly preferred chelants are the nonphosphorus chelants, such as EDDS and OEDBA. These chelants are believed to have attractive characteristics from the viewpoint of the environment; for example, EDDS has two chiral centers and not only synthetic or mixed isomers, but also the natural isomers such as the [S,S] isomer can be used compatibly with this invention. OEDBA, moreover, contains an unusual amido "backbone" which, it is believed, should significantly enhance the chelant biodegradability.

Of the foregoing chelants, all but OEDBA derivatives are well-known in the art. OEDBA is disclosed by Glogowski et al in application Ser. No. 392,168, filed Aug. 10, 1989, incorporated herein by reference.

A document generally useful in the context of this invention for its disclosure of commercial chemicals, including but not limited to chelants, their trademark names and commercial sources of supply, is "Chem Cyclopedia 91, The Manual of Commercially Available Chemicals", a publication of the American Chemical Society, 1990, ISBN 08412 - 1877-3, incorporated herein by reference.

EDDS is not yet known to be widely available in commerce; this chelant and its preparation are disclosed in documents including U.S. Pat. No. 4,704,233, Hartman et al, issued Nov. 4, 1987, incorporated herein by reference, and U.S. Pat. No. 3,077,487, Ramsey et al, issued Feb. 12, 1963, incorporated herein by reference.

Although, as noted, the sodium and potassium, i.e., alkali metal salts of the chelants are preferred, chelants useful herein can, in general, be in the acid form or can be partly or fully neutralized, e.g., as the sodium salt. In the fully neutralized alkali metal salts as described at the molecular level, the number of alkali metal ions will equal the number of anionic groups in the anion of the chelant. Thus, EDDS fully neutralized is a tetrasodium salt. Other chelants, such as DTPA, are available in more than one form, e.g., tetrasodium salt and pentasodium salt. Potassium salts are also useful herein and can usefully modify the viscosity characteristics of the premix.

It is moreover envisioned that the zwitterionic characteristics of some of the chelants, e.g., EDDS, can be put to good use in this invention. Thus, the sulfate salts of acid-form EDDS can likewise be useful herein to provide the chelant.

Preferred chelants include DTPA, EHDP, EDDS and OEDBA, very preferably in the sodium salt forms.

It is to be understood that the chelants employed herein are to be distinguished from builder salts, as listed hereinafter as a separate component of the present compositions. For example, chelants are exclusively organic and can bind to metals through their N,P,O coordination sites or mixtures thereof while builder salts can be organic or inorganic and, when organic, generally bind to metals through their O coordination sites. Moreover, the chelants typically bind to transition metals much more strongly than to calcium and magnesium; that is to say, the ratio of their transition metal binding constants to their calcium/magnesium binding constants is very high. By contrast, builder salts herein exhibit much less selectivity for transition metal binding, the above-defined ratio being generally lower. These ratios can readily be ascertained by referring to constants for the illustrative chelants and builder salts herein, the great majority of which can be found in the compilation "Critical Stability Constants" by A. E. Martell. Note that relatively small differences in ratio can be significant since the terms involved are logarithmic. Moreover, the chelants herein can as noted include N or P atoms, whereas the builder salts are selected from nonphosphorus materials and most preferably have anions consisting essentially of C, H and 0, i.e., they are preferably nitrogen-free.

Moreover, the chelants are used in the present compositions as part of the bleaching system. Indeed, and while not intending to be limited by theory, it is believed that it is their ability to bind transition metal cations which provides an important stabilizing function and enhanced stain-removal to the oxygen bleach systems herein.

Organic dispersant

The organic dispersants herein are used at levels of at least about 0.5%, typically from about 1% to about 12% or higher, most preferably from about 1% to about 4%; all percentages are on a weight basis of the final automatic dishwashing composition. Such organic dispersants are preferably water-soluble sodium polycarboxylates. ("Polycarboxylate" dispersants herein generally contain truly polymeric numbers of carboxylate groups, e.g., 8 or more, as distinct from carboxylate builders, sometimes called "polycarboxylates" in the art when, in fact, they have relatively low numbers of carboxylate groups such as four per molecule.) The organic dispersants are known for their ability to disperse or suspend calcium and magnesium "hardness", e.g., carbonate salts. Crystal growth inhibition, e.g., of Ca/Mg carbonates, is another useful function of such materials. Preferably, such organic dispersants are polyacrylates or acrylate-containing copolymers. "Polymeric Dispersing Agents, SOKALAN", a printed publication of BASF Aktiengesellschaft, D-6700 Ludwigshaven, Germany, describes organic dispersants useful herein. Sodium polyacrylate having a nominal molecular weight of about 4500, obtainable from Rohm & Haas under the tradename as ACUSOL 445N, or acrylate/maleate copolymers such as are available under the tradename SOKALAN, from BASF Corp., are preferred dispersants herein. These polyanionic materials are, as noted, usually available as viscous aqueous solutions, often having dispersant concentrations of about 30–50%. The organic dispersant is most commonly fully neutralized; however, the overall requirement with respect to neutralization is that the mixed chelant and organic dispersant (i.e., the step (a) premix as a whole) should be in the pH range of from about 5, preferably about 6, to about 10 or higher, most preferably about 7 to about 8.5. Overly acidic premixes can result in phase separation. Alkaline premixes can usefully convey some alkalinity (NAOH) to the formula but the excess alkalinity can result in a finished product that is overly caustic, handles less well, or cakes due to hygroscopicity.

While the foregoing encompasses preferred organic dispersants for use herein, it will be appreciated that other oligomers and polymers of the general polycarboxylate type can be used, according to the desires of the formulator. Suitable polymers are generally at least partially neutralized in the form of their alkali metal, ammonium or other conventional cation salts. The alkali metal, especially sodium salts, are most preferred. While the molecular weight of such dispersants can vary over a wide range, it preferably is from about 1,000 to about 500,000, more preferably is from about 2,000 to about 250,000, and most preferably is from about 3,000 to about 100,000. Nonlimiting examples of such materials are as follows.

For example, other suitable polymers include those disclosed in U.S. Pat. No. 3,308,067 issued Mar. 7, 1967, to Diehl, incorporated herein by reference. Unsaturated monomeric acids that can be polymerized to form suitable polymeric polycarboxylates include maleic acid (or maleic anhydride), fumaric acid, itaconic acid, aconitic acid, mesaconic acid, citraconic acid and methylenemalonic acid. The presence of monomeric segments containing no carboxylate radicals such as vinylmethyl ether, styrene, ethylene, etc. is suitable, preferably when such segments do not constitute more than about 40% by weight of the polymer.

Other suitable polymers for use herein are copolymers of acrylamide and acrylate having a molecular weight of from about 3,000 to about 100,000, preferably from about 4,000 to about 20,000, and an acrylamide content of less than about 50%, preferably less than about 20%, by weight of the polymer. Most preferably, the polymer has a molecular weight of from about 4,000 to about 10,000 and an acrylamide content of from about 1% to about 15%, by weight of the polymer.

Still other useful polymers include acrylate/maleate or acrylate/fumarate copolymers with an average molecular weight in acid form of from about 2,000 to about 80,000 and a ratio of acrylate to maleate or fumarate segments of from about 30:1 to about 2:1. Other such suitable copolymers based on a mixture of unsaturated mono- and dicarboxylate monomers are disclosed in European Patent Application No. 66,915, published Dec. 15, 1982, incorporated herein by reference. Yet other organic dispersants are useful herein, as illustrated by water-soluble oxidized carbohydrates, e.g., oxidized starches prepared by art-disclosed methods.

Bleach Active Salts

The essential bleach active salts in the instant invention are preferably selected from sodium perborates, sodium percarbonates, and mixtures thereof. Sodium persulfate can also be used. Sodium perborate tetrahydrate is useful herein, but sodium perborate monohydrate is especially preferred. These perborate salts are sometimes referred to as "peroxyborates". The bleach active salts will typically comprise from about 4% to about 15%, preferably from about 6% to about 12%, most preferably from about 7% to about 11% by weight of the final dishwashing composition. Commercial suppliers of suitable bleach active salts include Interox Corp., Degussa Corp., and du Pont. Various modified physical forms of bleach active salts, such as coated forms or modified granular forms, are known. The formulator may use such forms and will generally prefer those which are most storage-stable and which have best water-solubility.

Optional Bleach

Optional bleaches or bleach intermediates useful herein include activator materials such as tetracetylethylenediamine or pentaacetylglucose, as well as peracid materials such as monoperoxyphthalic acid magnesium salt, available from Aldrich Co., or as "H-48" from Interox Corp. Such optional bleaches are typically used at levels of from about 0.1% to about 5% by weight of the final dishwashing composition. Optional bleaches can be in the form of agglomerates or "prills" which may include compatible water-soluble nonbleach substances which can enhance the overall solubility or stability of the optional bleach component.

Water-Soluble Nonphosphorus Salts

In step (b) of the instant process, the mix from step (a) is contacted and mixed with water-soluble nonphosphorus salts. Such salts are typically materials which are moderately alkaline or, in any event, not highly alkaline, e.g., not materials such as pure sodium hydroxide or sodium metasilicate, although small amounts of such highly alkaline materials can be co-present with other salts. Salts useful herein include, for example, sodium sulfate, sodium citrate, sodium bicarbonate and sodium carbonate, and mixtures thereof. Two especially useful, moderately alkaline salt mixtures herein comprise sodium citrate dehydrate, sodium carbonate and sodium sulfate at weight ratios of about 1:1:3 and 1:3:10. Those familiar with the art of agglomeration will appreciate that physical modifications of the salts, e.g., to achieve increased surface area or more desirable particle shape, can be useful for improving the agglomeration characteristics.

Other materials useful as the water-soluble nonphosphorus salt herein include various nonphosphorus detergency builder salts. Organic builder salts useful herein are the carboxylate salts including citrates, itaconates, 2,2'-oxodisuccinates, tartrate succinates and the like. Especially preferred are the sodium citrates, such as disodium citrate dehydrate. Preferred inorganic builder salts useful herein are the carbonate builders. Especially preferred by way of carbonate builder is anhydrous sodium carbonate, which, although it acts as a precipitating builder, is freely usable; for example, when present at levels of from about 5% to about 30% of the fully-formulated automatic dishwashing composition, thanks in large part to the co-operative action of the above-described organic dispersant which prevents deposition of hardness films or scale on the dishes. Silicate builders are useful herein but are preferably admixed in step (c) and as such are not generally included in the water-soluble nonphosphorus salts incorporated in step (b). Especially preferred silicates are solid-form hydrous water-soluble silicates having $SiO_2$:$Na_2O$ mole ratios of from about 2:1 to about 2.4:1. Such silicates especially useful in the present invention are known as BRITESIL H20 and H24, available from PQ Corp. The silicates may, of course, be used as anticorrosion agents, rather than as builders, in the instant compositions. Such variation in intended functionality does not, however, change the present process.

The present compositions will typically comprise from about 30% to about 95%, preferably from about 35% to about 80%, of the nonphosphorus salts; the percentages are by weight of the final dishwashing product. In general, the salts are selected such that the final dishwashing composition will contain at least about 2%, preferably from about 10% to about 50%, most preferably from about 15% to about 40%, by weight of a nonphosphorus, water-soluble detergency builder salt, such as a sodium citrate/sodium carbonate mixture.

Surfactant

The compositions of this invention preferably contain from about 0.1% to about 10%, more preferably from about 0.5% to about 3% (by weight of final dishwashing composition) of low-foaming or de-foaming surfactants, preferably having good stability (e.g., resistance to bleach) in the product. Nonionic surfactants are preferred, especially those which are solid at 35° C. or below, preferably those which are solid at 25° C. or below. In preferred embodiments, the nonionic surfactant has a low cloud-point, as is found in nonionic surfactants derived from straight-chain fatty alcohols containing from about 16 to about 20 carbon atoms condensed with an average of from about 6 to about 12 moles of ethylene oxide per mole of alcohol. Preferably the ethoxylated nonionic surfactant so derived has a narrow ethoxylate distribution relative to the average. The ethoxylated nonionic surfactant can optionally contain propylene oxide in an amount up to about 15% by weight of the surfactant. Certain of the block polymer surfactant compounds sold under tradenames such as PLURONIC, PLURAFAC and TETRONIC by the BASF-Wyandotte Corp., Wyandotte, Mich., are suitable in the surfactant compositions of the invention.

Surfactants, both anionic and nonionic, derived from natural materials are useful herein, provided that their foaming tendencies are properly controlled.

Anionic surfactants such as the alkyl benzene sulfonates, alkyl sulfates, and the like, are usually not used in automatic dishwashing compositions, due to their high sudsing properties. If such materials are used, an effective antifoaming agent should be employed.

A preferred class of defoaming surfactants which are useful (though not essential) herein comprise the alkyl phosphates (see U.S. Pat. Nos. 4,714,562 and 3,314,891). Preferred low-sudsing $C_{16}$–$C_{20}$ alkyl phosphates include monostearyl acid phoshate (MSAP), monooleyl acid phosphate, and salts thereof, especially their alkali metal salts. The alkyl phosphates are typically used in combination with nonionic surfactants, noted above.

Enzymes

Amylases, proteases and lipases, with mixtures of amylases and proteases, or amylases, alone, being preferred, are useful cleaning adjuncts in the compositions of this invention. Suitable proteolytic enzymes for use in the present invention include ESPERASE, SAVINASE and ALCALASE sold by Novo Industries of Copenhagen, Denmark. Suitable amylase and lipase enzymes include TERMAMYL and LIPOLASE, also sold by Novo Industries. See also U.S. Pat. No. 4,101,457, Place et al, issued Jul. 18, 1978, for further useful disclosures in connection with enzymes. Enzymes typically comprise from about 0.2% to about 5% by weight of the final compositions; percentage calculation based on the amount of commercial enzyme composition added, recognizing that such compositions typically comprise conventional enzyme stabilizers, so that the activity is generally not 100%.

Optional Additives

China protecting agents, including zinc and aluminum salts, aluminosilicates, aluminates, layer silicates, etc., can be present in amounts of from about 0.1% to about 5%, preferably from about 0.5% to about 2%.

Hydrotrope materials such as sodium benzene sulfonate, sodium toluene sulfonate, sodium cumene sulfonate, etc., can be present in minor amounts.

Bleach-stable perfumes (stable as to odor), crystal modifiers, dyes, and the like, can also be added in minor amounts.

Packaging

After mixing the final components to complete the compositions, the fully-formulated automatic dishwashing detergents are preferably packed out into cartons. In general, conventional granular automatic dishwashing detergent packaging can be used; however, reclosable cartons are preferred and plastic bottles are most highly preferred. Such packaging in general is impermeable, so that the product is not unnecessarily exposed to humidity.

EXAMPLE I

Nonperfumed premix of chelant and organic dispersant (illustrates step [a] of the process and illustrates the useful intermediate composition formed thereby): 100 lbs. of a solution of the pentasodium salt of DTPA (VERSENEX 80 Chelating Agent from Dow Chemical, 41% total solids) is mixed with 500 lbs. of a sodium polyacrylate solution (ACUSOL 445N from Rohm and Haas Company, 4500 mol. wt., 45% solids) in an agitated liquid mixing tank to yield 600 lbs. of the composition noted in Table 1.

TABLE 1

| Organic Dispersant/Chelant Mixture Composition (wt. %) | |
|---|---|
| Sodium polyacrylate (anhydrous basis) | 37.50 |
| DTPA Pentasodium Salt (anhydrous basis) | 6.83 |
| Water | 55.67 |
| Total | 100.00 |

EXAMPLE II

Perfumed premix of chelant and organic dispersant (illustrates step [a] of the process and illustrates the useful intermediate composition formed thereby): 98.1 lbs. of a solution of the pentasodium salt of DTPA (VERSENEX 80 Chelating Agent from Dow Chemical, 41% total solids) and 9.75 lbs. of lemon perfume are mixed into 510 lbs. of a sodium polyacrylate solution (ACUSOL 445N from Rohm and Haas Company, 4500 mol. wt., 45% solids) in an agitated liquid mixing tank to yield 617.85 lbs. of a mixture with the composition noted in Table 2.

TABLE 2

| Dispersant/Chelant/Perfume Mixture Composition (wt. %) | |
|---|---|
| Sodium polyacrylate (anhydrous basis) | 37.14 |
| DTPA Pentasodium Salt (anhydrous basis) | 6.51 |
| Lemon perfume | 1.58 |
| Water | 54.77 |
| Total | 100.00 |

EXAMPLE III

An automatic dishwashing composition having the final composition listed in Table 3 is prepared according to the procedure described below:

TABLE 3

| Finished Product Composition (wt. %) | |
|---|---|
| Sodium citrate dihydrate, anhydrous basis | 14.92 |
| Sodium carbonate anhydrous, anhydrous basis | 14.82 |
| Sodium sulfate, anhydrous basis | 32.92 |
| Sodium polyacrylate, anhydrous basis | 2.94 |
| DTPA pentasodium salt, anhydrous basis | 0.51 |
| Nonionic surfactant/MSAP | 2.57 |

TABLE 3-continued

| Finished Product Composition (wt. %) | |
|---|---|
| Perfume | 0.12 |
| BRITESIL H2O, PQ Corp., as supplied | 16.67 |
| Sodium perborate monohydrate, (no hydration correction applied) | 9.84 |
| TERMAMYL 60T | 1.50 |
| ESPERASE 6.0T | 1.00 |
| Water | 2.19 |
| Total | 100.00 |
| pH, 1% aqueous solution: | 10.7 |
| Density: | 0.9 grams per cubic centimeter |

Step (a): Making the premix: The procedure of Example II is repeated without modification.

Step (b): Mixing/drying the fluid premix with solid-form water-soluble nonphosphorus salts—Particulate agglomerates are prepared by continuously agglomerating in a Schugi FX-160 mixer operating at 3,000 rpm with mixing blades set at positive 5° angles.

Nonphosphorus salts comprising particulate solid sodium citrate dihydrate, sodium carbonate, and sodium sulfate are fed into the Schugi mixer through a single feed chute.

The fluid premix of step (a) is contacted with the nonphosphorus salts by spraying through a single external mix air atomization nozzle (Spraying Systems #60100 fluid cap, #134255-45 air cap) at a temperature of about 100°-102° F.

There is included an optional nonionic surfactant (a blend of ethoxylated monohydroxy alcohol and polyoxyethylene/polyoxypropylene block polymer, including 3.2% monostearyl acid phosphate "MSAP", for suds suppression) in the amounts set forth in Table 4. The nonionic surfactant is sprayed on through a second external mix air atomization nozzle (Spraying Systems #60100 fluid cap, #134255-45 air cap) at a temperature of about 150° F.

The wet agglomerate is dried down to a total moisture content of about 3.1% in a fluidized bed dryer, indicating that about 64 lbs./hr. of water is removed in drying, leaving less than 0.2% free moisture.

In more detail, drying is accomplished in a 10.4 square foot fluid bed dryer divided into three separate drying zones. Each zone is separated from the next by a fixed-height Weir. Conditions are given in Table 5 below. Air flows are adjusted to provide adequate fluidization.

TABLE 4

| Agglomeration/Drying Material Balance | Stock Material | Water in Stock |
|---|---|---|
| Sodium citrate dihydrate | 258 lbs/hr | 31.4 lbs/hr |
| Sodium carbonate | 225 | — |
| Sodium sulfate | 500 | — |
| Total Dry Components | 983 | 31.4 |
| Premix (from step [a]) | 120 | 65.7 |
| Nonionic | 39 | — |
| Total liquids | 159 | 65.7 |
| Total Wet Agglomerate | 1142 lbs/hr | 97.1 |
| Drying (water removed) | 64 | 64 |
| Dry Agglomerate | 1078 lbs/hr | 33.1 |

TABLE 5

| Fluid Bed Dryer Conditions | | | |
|---|---|---|---|
| Weir height (in.) | 6.5 | 5.5 | 5.5 |

TABLE 5-continued

| Fluid Bed Dryer Conditions | | | |
|---|---|---|---|
| Inlet air temperature (°F.) | 283.0 | 159.0 | 84.0 |
| Average bed temperature (°F.) | 198.0 | 163.0 | 108.0 |

This agglomeration and drying step yields a particulate agglomerate with the following composition:

TABLE 6

| Dry Agglomerate Composition | |
|---|---|
| Sodium citrate anhydrous | 21.02% |
| Sodium carbonate anhydrous | 20.87 |
| Sodium sulfate anhydrous | 46.38 |
| Sodium polyacrylate anhydrous | 4.14 |
| DTPA pentasodium salt anhydrous | 0.72 |
| Nonionic surfactant/MSAP | 3.62 |
| Perfume | 0.18 |
| Water | 3.07 |
| Total | 100.00 |

Step (c)—The fully-formulated automatic dishwashing detergent product is prepared according to Table 7 by blending in a standard low energy drum mixer yielding the finished product composition shown in Table 3.

TABLE 7

| Mixing of Fully-Formulated Product | |
|---|---|
| Dry agglomerate of Table 6 | 70.99% |
| Sodium perborate monohydrate (from Degussa, AvO = 15.24%) | 9.84 |
| Hydrous sodium silicate ($SiO_2$:$Na_2O$ is 2:1; BRITESIL H-20 from PQ Corp) | 16.67 |
| TERMAMYL 60T enzyme (from Novo) | 1.50 |
| ESPERASE 6.0T enzyme (from Novo) | 1.00 |
| Total | 100.00 |

EXAMPLE IV

The composition of Example III is modified by replacing the DTPA chelant with an equivalent amount of EDDS chelant.

EXAMPLE V

The composition of Example III is modified by replacing the DTPA chelant with an equivalent amount of OEDBA chelant, tetrasodium salt.

EXAMPLE VI

The composition of Example III is modified by removing the nonionic surfactant.

The following Examples further illustrate granular automatic dishwashing compositions prepared in the foregoing manner, and are given here by way of illustration and not by way of limitation. In-use, such compositions (typically, from about 20 g. to about 150 g., in accordance with the manufacturer's recommendation, are placed in the dispensing receptacles of a standard domestic automatic dishwashing appliance, which is then operated according to the appliance manufacturer's instructions. Larger or smaller quantities of the compositions can be used, depending on the load of dishes and the load and type of soils being removed therefrom.

In Examples VII–XI, the listed ingredients and amounts comprise the following.

Citrate=disodium citrate dehydrate; percentage on anhydrous basis

Carbonate=anhydrous sodium carbonate

Hydrous silicate=2:1 $SiO_2$:$Na_2O$ sodium silicate as BRITESIL H2O, PQ Corp., (as supplied).

Metasilicate=sodium metasilicate pentahydrate.

Surfactant mix=nonionic surfactant as in Example III

Alternate nonionic surfactant=SYNPERONIC LF/RA43, PLURAFAC LF403 or equivalent nonionic surfactant (sources include BASF Corp.)

Polyacrylate dispersant=as sodium polyacrylate avg. mol. wt. 4500, anhydrous basis.

Organic dispersant=sodium acrylate/co-maleate, available as SOKALAN CP-5 from BASF Corp., anhydrous basis.

DEQUEST 2060=chelant: sodium salt of diethylenetriaminepenta(methylenephosphonic acid), Monsanto Corp., anhydrous basis.

DTPA=diethylenetriamine pentaacetate, sodium salt, anhydrous basis.

TERMAMYL 60T=enzyme prill, available from Novo

ESPERASE 6.0T=enzyme prill, available from Novo

Sulfate=sodium sulfate, anhydrous basis

Perfume—optional; includes lemon and floral perfumes

TAED=Tetra-acetylethylenediamine

SAVINASE 6.0T=enzyme prill, available from Novo

As used herein, free moisture content is determined by placing 5 g of a sample of the detergent to be tested in a petri dish, placing the sample in a convention oven at 50° C. (122° F.) for 2 hours, followed by measurement of the weight loss due to evaporation.

EXAMPLES VII–XI

| Ingredient | Percent in Finished Composition | | | | |
|---|---|---|---|---|---|
| | VII | VIII | IX | X | XI |
| Citrate | 15.00 | 15.00 | 21.07 | 21.07 | 15.00 |
| Carbonate | 15.00 | 15.00 | — | 15.00 | — |
| Hydrous silicate | 18.52 | 18.52 | 30.56 | 18.52 | 30.56 |
| Metasilicate | — | — | 4.00 | — | 4.00 |
| Surfactant mix | 2.58 | 2.58 | — | — | — |
| Alternate nonionic surfactant | — | — | 1.50 | 1.50 | 1.50 |
| Polyacrylate dispersant | 4.00 | 4.00 | — | — | — |
| Organic dispersant | — | — | 12.00 | 12.00 | 4.00 |
| DEQUEST 2060 | — | — | 0.80 | 0.80 | 0.80 |
| DTPA | 0.70 | 0.70 | — | — | — |
| Sodium perborate monohydrate | 9.84 | 9.84 | 7.10 | 7.10 | 7.10 |
| TAED | — | — | 2.00 | 2.00 | 2.00 |
| TERMAMYL 60T | 1.50 | — | 0.50 | 0.50 | 1.50 |
| ESPERASE 6.0T | 1.00 | — | — | — | 1.00 |
| Sulfate | 29.11 | 31.61 | 16.5 | 17.54 | 30.11 |
| Perfume | 0.17 | 0.17 | — | — | — |
| SAVINASE 6.0T | — | — | — | — | — |
| Water | Balance (to 100%) | | | | |

EXAMPLES XII–XIII

| Ingredient | Percent in Finished Composition | |
|---|---|---|
| | XII | XIII |
| Citrate | 5.00 | 10.00 |
| Carbonate | 15.00 | 23.38 |
| Hydrous silicate | 18.52 | 37.04 |
| Metasilicate | — | — |
| Surfactant mix | 3.0 | 5.0 |
| Alternate nonionic surfactant | — | — |

-continued

EXAMPLES XII–XIII

| Ingredient | Percent in Finished Composition XII | XIII |
|---|---|---|
| Polyacrylate dispersant | 2.0 | 4.0 |
| Organic dispersant | — | — |
| DEQUEST 2060 | — | — |
| DTPA | 0.7 | 1.4 |
| Sodium perborate monohydrate | 9.84 | 13.12 |
| TAED | — | — |
| TERMAMYL 60T | 1.0 | 2.0 |
| ESPERASE 6.0T | — | — |
| Sulfate | 42.58 | — |
| Perfume | 0.17 | 0.17 |
| SAYINASE 6.0T | 1.0 | 2.0 |
| Water | Balance (to 100% | |

In the foregoing Examples, the sodium perborate monohydrate can be replaced by an equivalent amount of sodium percarbonate to provide equivalent compositions.

What is claimed is:

1. A process for making a granular automatic dishwashing detergent which is substantially free from inorganic phosphate builders, comprising:

(a) forming a fluid premix comprising an aqueous mixture of a chelant and a polymer organic dispersant containing at least 8 carboxylate groups, said chelant and organic dispersant being at a weight ratio of from about 3:1 to about 1:300, dry basis, and said fluid premix comprising from about 30% to about 70% water and about 30% or higher of the sum of said chelant and said organic dispersant at a pH of combined chelant and dispersant in the range from about 7 to about 8.5;

(b) in one or more mixing/drying steps, co-contacting the fluid premix of step (a) with solid-form water-soluble nonphosphorus salts which comprises a mixture of sodium citrate, sodium carbonate and sodium sulfate in weight ratios of from about 1:1:3 to about 1:3:10, at a weight ratio of said fluid premix to solid-form water-soluble nonphosphorus salts of from about 1:30 to about 1:4 to form a particulate agglomerate and drying said agglomerate to about 8%, or less, free moisture; and (c) one or more steps of mixing the particulate agglomerate of step (b) with solid-form particulate admixes comprising bleach active salts selected from the group consisting of sodium perborates, sodium percarbonates and mixtures thereof, said bleach-active salts constituting 3% or more, dry weight basis, of the total composition.

2. A process according to claim 1 wherein said chelant is selected from the group consisting of ethylenediaminetetraacetic acid, ethylenediaminetetra(methylenephosphonic acid), diethylenetriaminepenta(methylene phosphonic acid), diethylenetriaminepentaacetic acid, hydroxyethylenediaminetriacetic acid, triethylenetetraminehexaacetic acid, hydroxyethylidinediphosphonic acid, nitrilotriacetic acid, N,N'-(1-oxo-1,2,-ethanediyl)-bis-(aspartic acid), and ethylenediaminedisuccinic acid and said dispersant is selected from the group consisting of sodium polymeric polycarboxylates.

* * * * *

UNITED STATES PATENT AND TRADEMARK OFFICE

CERTIFICATE OF CORRECTION

PATENT NO. : 5,292,446
DATED : March 8, 1994
INVENTOR(S) : Jeffrey D. Painter et al.

It is certified that error appears in the above-indentified patent and that said Letters Patent is hereby corrected as shown below:

In Column 3, line 18, change "dehydrate" to --dihydrate--.
In Column 4, line 53, change "acidity" to --acidify--.
In Column 9, line 16, change "dehydrate," to --dihydrate,--.
In Column 9, line 29, change "dehydrate." to --dihydrate.--.
In Column 13, line 66, change "dehydrate;" to --dihydrate.--.

Signed and Sealed this

Ninth Day of May, 1995

*Attest:*

BRUCE LEHMAN

*Attesting Officer*

*Commissioner of Patents and Trademarks*